US008769900B2

(12) United States Patent
MacDonald

(10) Patent No.: US 8,769,900 B2
(45) Date of Patent: Jul. 8, 2014

(54) BUILDING CONSTRUCTION SYSTEM

(75) Inventor: Ian MacDonald, Hope Island (AU)

(73) Assignee: Macholdings (Aust) Pty Ltd, Tamborine (AU)

( * ) Notice: Subject to any disclaimer, the term of this patent is extended or adjusted under 35 U.S.C. 154(b) by 0 days.

(21) Appl. No.: 12/664,521

(22) PCT Filed: May 12, 2008

(86) PCT No.: PCT/AU2008/000660

§ 371 (c)(1),
(2), (4) Date: Jun. 18, 2010

(87) PCT Pub. No.: WO2008/151355

PCT Pub. Date: Dec. 18, 2008

(65) Prior Publication Data

US 2010/0263313 A1 Oct. 21, 2010

(30) Foreign Application Priority Data

Jun. 15, 2007 (AU) ..... 2007100518

(51) Int. Cl.
*E04B 2/30* (2006.01)

(52) U.S. Cl.
USPC ..... 52/483.1; 52/649.1

(58) Field of Classification Search
USPC ..... 52/483.1, 649.1
See application file for complete search history.

(56) References Cited

U.S. PATENT DOCUMENTS

| | | | | |
|---|---|---|---|---|
| 5,079,890 | A | 1/1992 | Kubik et al. | |
| 6,023,902 | A | 2/2000 | So | |
| D598,219 | S * | 8/2009 | Sparks, Jr. | D6/462 |
| 2002/0092251 | A1 * | 7/2002 | Alvaro et al. | 52/309.1 |

FOREIGN PATENT DOCUMENTS

| | | |
|---|---|---|
| AU | 708031 | 2/1995 |
| WO | WO 85/03966 A1 | 9/1985 |
| WO | WO00/65166 A1 | 11/2000 |
| WO | WO/03/062548 A1 | 7/2003 |

* cited by examiner

*Primary Examiner* — Mark Wendell
(74) *Attorney, Agent, or Firm* — Harris Beach PLLC; Neal L. Slifkin

(57) ABSTRACT

A panel assembly for a building structure including a support frame that is mountable relative to a building substrate, the support frame including a plurality of first members extending in a first direction and at least one member extending in a second direction and overlaying the members in the first direction, at least one sheeting member provided on at least one side of the support frame so that the support frame and the structural sheeting define a zone for a cementitious material, and a layer of cementitious material positioned against the structural sheeting to at least partially fill the zone.

15 Claims, 17 Drawing Sheets

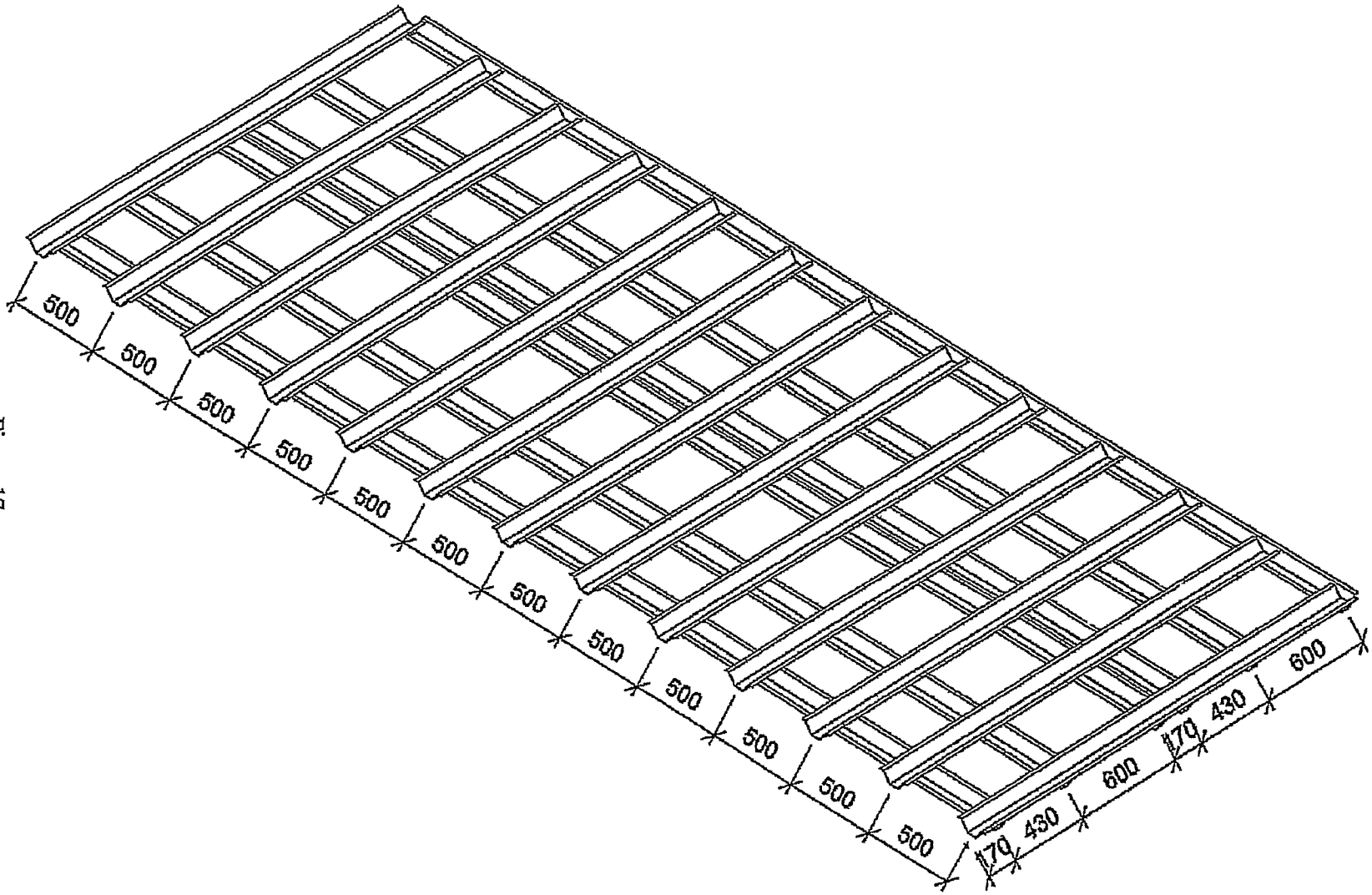
500
500
500

BUILDING CONSTRUCTION SYSTEM

FIELD OF THE INVENTION

The present invention relates to a building construction system. More particularly, this invention relates to a method of construction and to the various structures formed according to that method.

BACKGROUND ART

The competitive nature of the building industry has led to a need for cost-effective methods of construction. As is well known, cost effectiveness is achieved by simplicity and efficiency in construction. A major component of the cost of building is labour, those skilled and unskilled. This is particularly so in first world countries such as Australia and the United States.

Prefabricated components such as frames and panels and even fully prefabricated structures in knockdown form have been used. The aim of these concepts is to achieve a structure that can be rapidly assembled on site by non-skilled labour.

These concepts have faced a number of difficulties. One particular difficulty is the fact that building standards vary considerably throughout regional and geographic areas. An example of this is wind-loading standards for roofing and wall structures which vary significantly throughout a country such as Australia. These standards include specific requirements in cyclone rated areas.

The problem with the conventional concepts is that they are generally incapable of complying with such a variation in requirements.

The present inventor has previously developed a steel reinforced concrete wall construction system. Fibre reinforced cement sheet is supported on a steel frame wall to define a substrate for sprayed concrete. This system was a development of a method for forming screeded reinforced concrete walls in underground excavations such as car parks.

Australian patent number 708031 requires skilled labour to erect steel wall framing on site. This entails substantial design work depending upon building code requirements for differing geographical regions. Furthermore, the flexibility of the structure during application of the sprayed concrete induces a degree of thixotropy to the applied layer in some cases causing it to flow downwardly on the fibre cement sheeting support substrate.

The present inventor has also developed an improvement to the system used in Australian patent number 708031. This improvement includes a panel assembly for a building structure including a support frame that is mountable on a substrate, structural sheeting provided on the support frame so that the support frame and the structural sheeting define a zone for a cementitious material, a layer of cementitious material positioned against the structural sheeting to fill the zone and at least one post-tensioning member that extends through the layer of cementitious material with predetermined tension applied to the member.

The present inventor has now furthered the invention to simplify construction and increase efficiency.

It will be clearly understood that, if a prior art publication is referred to herein, this reference does not constitute an admission that the publication forms part of the common general knowledge in the art in Australia or in any other country.

SUMMARY OF THE INVENTION

The present invention is directed to an improved building construction system, which may at least partially overcome at least one of the above-mentioned disadvantages or provide the consumer with a useful or commercial choice.

In one form, the invention resides in an improved building construction system including a panel assembly for a building structure including a support frame that is mountable on a substrate, structural sheeting provided on the support frame so that the support frame and the structural sheeting define a zone for a cementitious material, cementitious material positioned against the structural sheeting to at least partially fill the zone wherein the support frame includes a plurality of members extending in a first direction and at least one member extending in the second direction, each of the members adapted to attach either structural sheeting or other members.

In an alternative form, there is provided a method of constructing a panel assembly for a building structure, the method including the steps of:

erecting a support frame on a substrate, the support frame including a plurality of members extending in a first direction and at least one member extending in the second direction, each of the members adapted to attach either structural sheeting or other members;

mounting structural sheeting on the support frame so that the support frame is positioned between a pair of structural sheets and the support frame and structural sheeting together define a zone in which cementitious material is to be set;

applying a cementitious, settable material to an inner surface of the structural sheeting to at least partially fill the zone with the settable material; and allowing the cementitious material to set.

In a third form, the invention resides in a panel assembly for a building structure including a support frame that is mountable relative to a building substrate, the support frame including a plurality of members extending in a first direction and at least one member extending in a second direction and overlaying the members in the first direction, at least one sheeting member provided on at least one side of the support frame so that the support frame and the structural sheeting define a zone for a cementitious material, and cementitious material positioned against the structural sheeting to at least partially fill the zone.

According to the invention one or more post-tensioning members may be used. In particular, the post-tensioning members may extend through the settable material. Once the cementitious material has set to a predetermined extent, the predetermined tension will typically be applied to the post-tensioning member.

Erecting the support frame on the substrate may include the step of positioning a pair of spaced support members on the substrate and fastening a bridging member to free ends of the pair of spaced support members.

The method may further include the step of mounting formwork on the support frame so that the zone is bounded by the structural sheeting, the support frame and the formwork and introducing the cementitious material into the zone to cast the cementitious material in situ. The formwork may be removed once the cementitious material has set.

The method may include the step of spraying the cementitious material into the zone. In this case the method may include the step of removably securing transverse support members to the structural sheeting to support the structural sheeting while the cementitious material is sprayed onto the structural sheet.

Preferably, at least two vertically spaced support members are removably secured between opposite ends of the support frame.

The method may further include the step of positioning steel reinforcing in the zone prior to applying the settable cementitious material.

The method may include the steps of:

initially applying the cementitious settable material to alternate zones;

allowing the material instead alternate zones to at least partially set;

applying the settable material to remaining zones; and using the at least partially set material in alternate zones as a guide for screeding the material in the remaining zones.

The building construction system of the present invention may be located relative to, and preferably above, a building system of a more conventional nature. For example, one of the present inventor's previous inventions provided a method of constructing a basement wall assembly, the method including the steps of positioning a layer of sheet piling against soil to be retained, positioning structural sheeting relative to the layer of sheet piling so that the layer of sheet piling and the structural sheeting define a zone for a cementitious material, applying a layer of cementitious material to the zone, and allowing the cementitious material to at least partially set. Normally, at least one post-tensioning member was located adjacent the layer of sheet piling, within the zone and after the cementitious material was allowed to at least partially set, a predetermined tension was applied to the, or each post-tensioning member. This method of construction was typically used to construct basement walls.

Accordingly, the panel construction of the present invention may be used in association with the above described construction to define upper level walls or floors of a structure.

Various types of cementitious material could be used including concrete with various additives such as a polypropylene fibre mesh. Also, various types of structural sheeting such as those formed of compressed fibre cement could be used.

The support frame members will typically be manufactured of metal, either galvanised or non-galvanised but normally galvanised metal having rust resistant properties will be used. The members will normally be shaped to provide strength both longitudinally and laterally. In a particularly preferred form, each of the first and second members will be box-shaped or even more preferred is a cross-sectional shape with a first planar side wall, a first angled wall, a central wall parallel with the planar side wall, a second angled wall angled in the opposite direction to the first angled wall and a second side wall parallel to both the first side wall and central wall. This more preferred member shape possesses exceptional strength as well as an ability to flex to a point due to the angled walls. Normally both the first members and the second members will have the preferred shape. Normally the members will be attached to each other via abutting central walls of respective first and second members.

The support frame will typically include first members extending in a first direction and second members extending in a second direction, the directions being perpendicular to one another. The support frame may further include a third set of members extending in the same direction as the first members and the first an third set of members are preferably mounted to opposite sides of the second set of members. The third members will also preferably have the preferred cross-sectional profile.

The members will preferably be the same members simply oriented in different directions. The members will also preferably be a standard height between the side walls and the centre wall, preferably 50 mm. For example, using a 7.5 mm thick sheeting member on both sides makes a panel 115 mm thick and a three layer support structure with sheets on both sides results in a 165 mm thick panel.

The members of the support frame may be fastened together using any suitable method including welding, or screw fasteners any normally the members may be both screwed and welded together.

Normally, the support frame will be a regular array of members with a plurality of first members and a plurality of second members and optionally, a plurality of third members.

The panel assembly will also have at least one sheeting member applied to at least one side and normally both sides of the support frame. The interior of the defined panel will typically be at least partially filled with cementitious material. The sheeting may be manufactured from any one or more of a variety of materials including fibre cement, and alternate materials such as compressed recycled newspaper, rubber and other materials. It is particularly preferred that the sheeting material use materials appropriate for use in carbon trading, carbon sequestration or sustainable building. For example, materials such as wood may be used for the sheeting material. Alternative materials may also be used such as for example, a specially prepared hemp with a carbon credit or other fibrous material, preferably natural, and a lime/cement binder to form a composite building material or concrete including 50% ground granulated blast slag (GGBS). Any material may be used which may provide an advantage to the structure in the form of a reduced carbon impact.

Examples of additives to the sheet include for example, chemical or physical additives such as cellulose, recycled rubber materials, fly ash, bentonite, plastic or polymeric materials such as styrene, or glass or polypropylene fibres. The sheet may be manufactured of materials such as Pearlite or recycled newspaper with appropriate strength characteristics and appropriately waterproofed.

The sheeting may be finished or unfinished. A finished sheet may be used as an internal wall. The sheets will typically be attached to the support frame via attachment to the side walls of the respective members. When attached this way, the central walls of a two layer support frame will typically be attached to each other orienting the side walls outwardly on both sides of the support frame. In this configuration, sheeting may be attached to both sides of the support frame to form a wall and define a cavity between the sheeting and about the support frame. Alternatively, the sidewalls of the respective first and second members may be attached to each other orienting the central walls outwardly for attachment of the sheet(s). Again, sheeting can be attached to one or both sides of the support frame.

The sheeting may be associated with insulating material, particularly preferred form of which is styrene foam. The insulating material will typically be provided as a layer adjacent the sheeting. Preferably the insulating material is located between the sheet and the support frame. The layer of insulating material may be attached to the sheeting for ease of attachment of the sheeting to the support frame. A further advantage to providing the insulating material on the sheeting is that one or more voids can be formed in the insulating material for utilities and the like to extend through the panel assembly.

Normally, the support frame may have a particular orientation when used for buildings, namely vertical members oriented towards the outside of the building and the horizontal members to the inside.

The cementitious material will normally be a settable material such as concrete. Other materials may be used instead of concrete or in combination with concrete to adjust the properties of the panel to form, for example a panel with internal insulation. Examples of additives to the concrete include for example, chemical or physical additives such as cellulose, recycled rubber materials, fly ash, bentonite, plastic or polymeric materials such as styrene, or glass or polypropylene fibres. The cementitious material may be applied in layers and may fill only a part of the zone or substantially fill the zone. A plastic material may be used such as expandable polystyrene. One or more cavities may be formed or contained in the set material to form conduits through the panel, such as for utilities or similar. Layers of material may be used in addition to the sheeting and will normally be located between the sheet and the support frame.

The panel of the present invention may be used in combination with the system taught in Australian patent number 708031. The prior system is generally used with a sheet pile to form a structural wall especially well adapted to use as a wall in a lower portion of a building such as a basement for example and the panel of the present invention is especially well adapted for use as an upper wall, positioned above the basement wall.

The panel of the present invention also adapted for use as a floor panel being substantially horizontally disposed as contrasted to a wall or fence panel as previously discussed which are typically substantially vertically disposed.

The floor panel is configured as described above with a plurality of members extending in a first direction and a plurality of members extending in a second direction, each of the members adapted to attach to the members extending in the other of the directions in a back to back configuration. The members preferably have a first planar side wall, a first angled wall, a central wall parallel with the planar side wall, a second angled wall angled in the opposite direction to the first angled wall and a second side wall parallel to both the first side wall and central wall. The central walls of the respective members extending in different directions are normally attached to one another where the members overlie one another.

A sheet member is typically attached to either side of the support frame. Typically, a sheet member may be applied to one side of the support frame, and the single sided assembly them put in place. A cementitious material is then usually located into the cavity defined about the support frame and the upper sheet member attached to the other side of the support frame to form the panel.

In a further form, the invention resides in an improved building construction system including a panel assembly for a building structure including a support frame that is mountable on a substrate, structural sheeting provided on the support frame so that the support frame and the structural sheeting define a substantially hollow zone between the structural sheeting, wherein the support frame includes a plurality of members extending in a first direction and at least one member extending in the second direction, each of the members adapted to attach either structural sheeting or other members.

The present invention is adapted for use as a wall, fence, retaining wall, floor structure or any type of barrier or divider assembly and the configuration will typically be adapted for each of these applications.

BRIEF DESCRIPTION OF THE DRAWINGS

Various embodiments of the invention will be described with reference to the following drawings, in which:

FIG. 17 is a perspective view of a support frame for the floor panel illustrated in FIG. 16 with sheet members removed.

DETAILED DESCRIPTION OF THE PREFERRED EMBODIMENT

According to an aspect of the present invention, a panel assembly and method of formation is provided.

Figure 1:
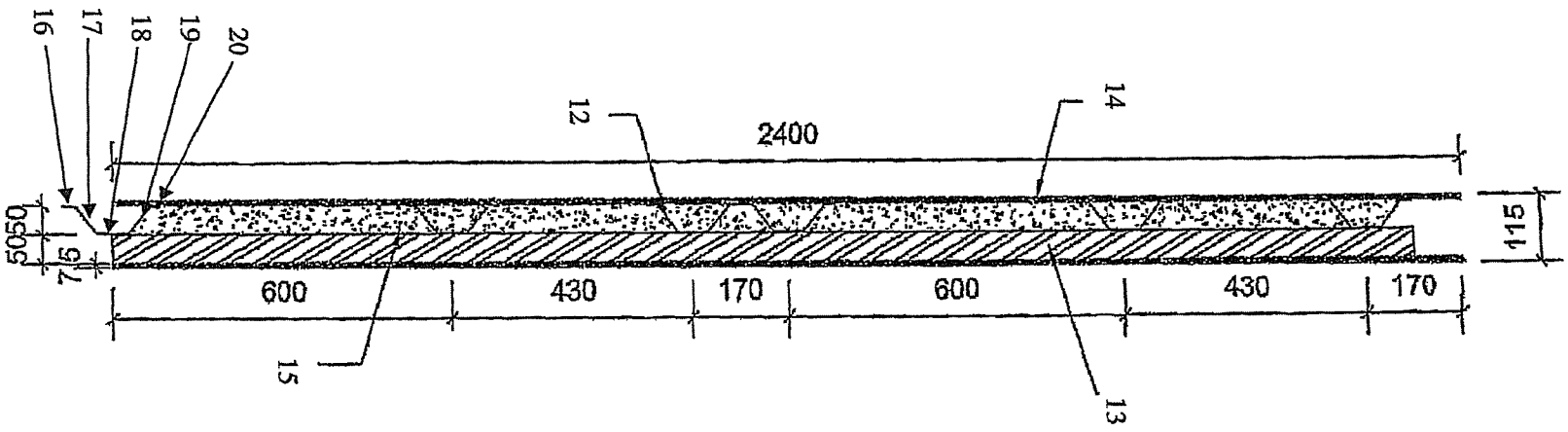
FIG. 1 is a sectional view of a panel assembly with a two layer support frame according to a preferred embodiment of the present invention.
Figure 2:
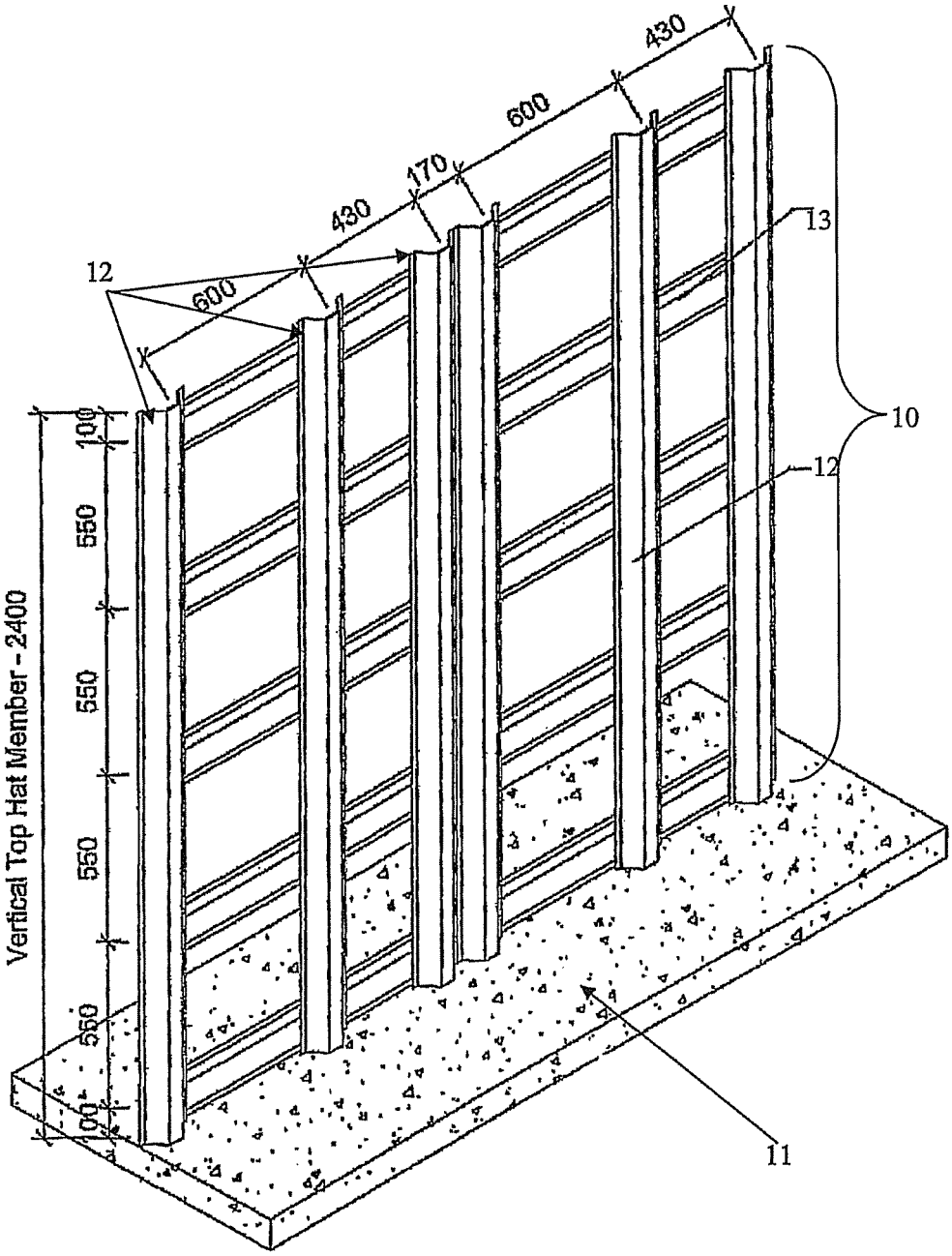
FIG. 2 is a perspective view of a 2400 mm panel assembly with two layer support frame with sheet members removed.
Figure 3:
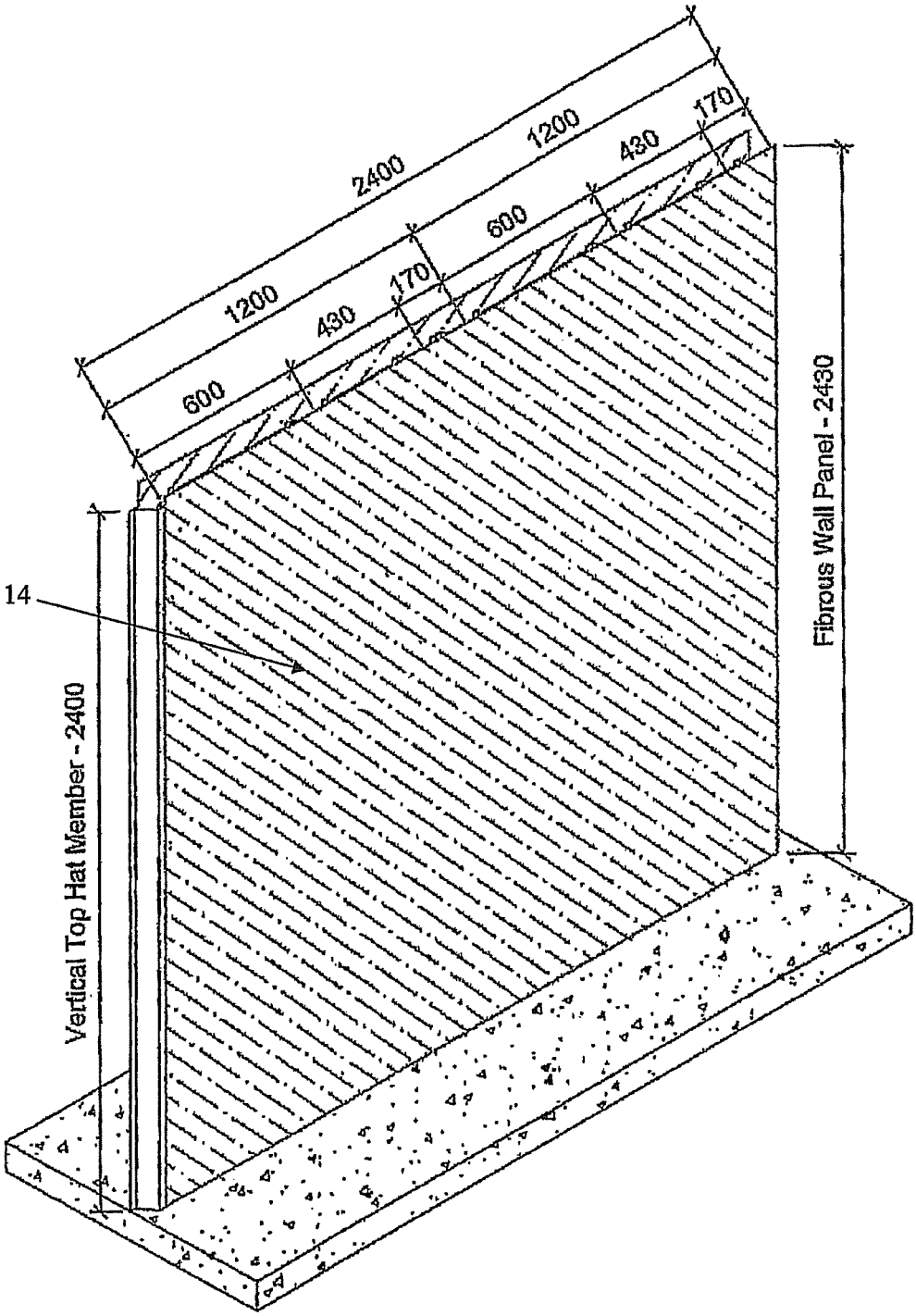
FIG. 3 is a perspective view of the panel assembly of FIG. 2 with sheeting applied.
Figure 4:
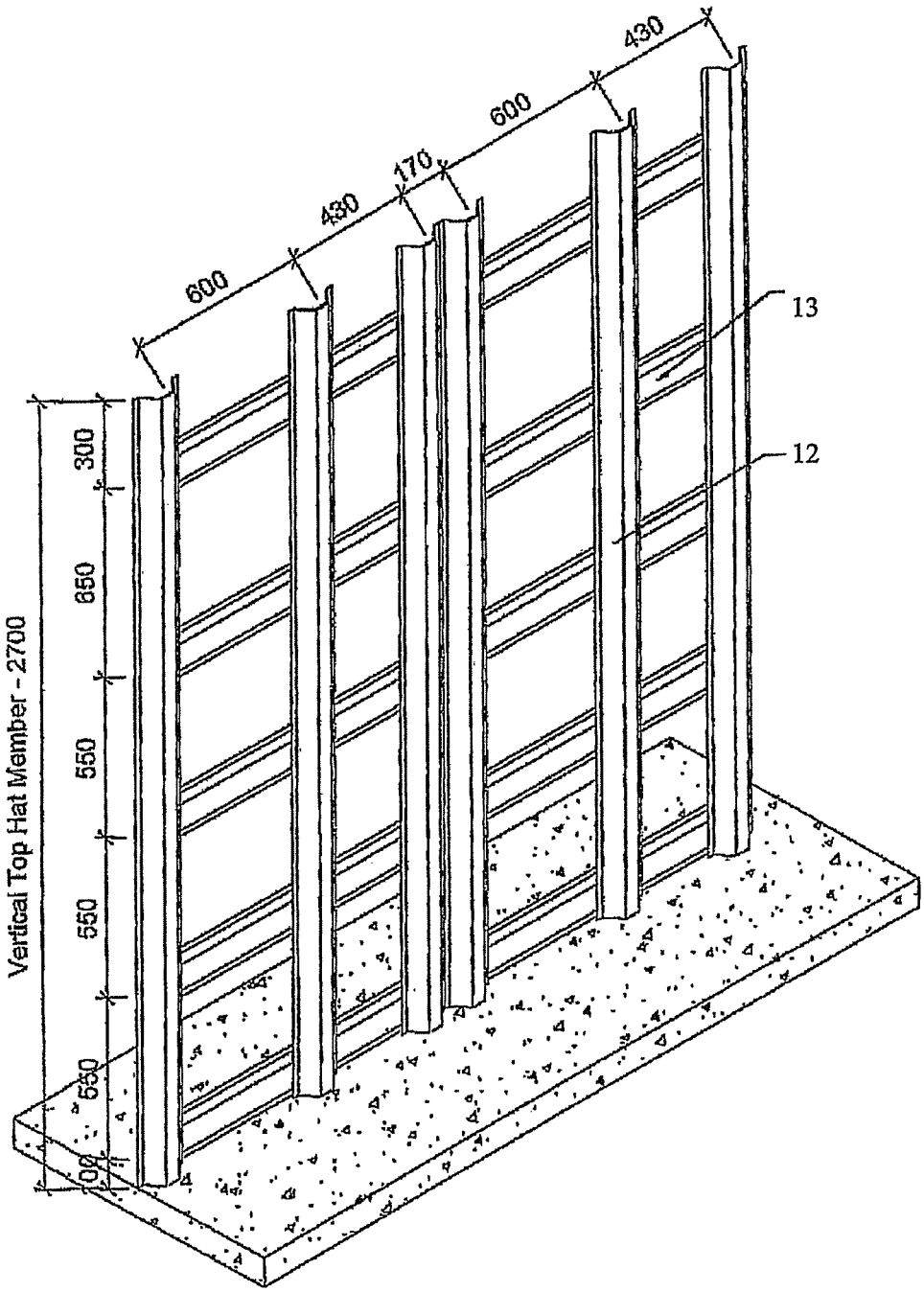
FIG. 4 is a perspective view of a 2700 mm panel assembly with two layer support frame with sheet members removed.
Figure 5:
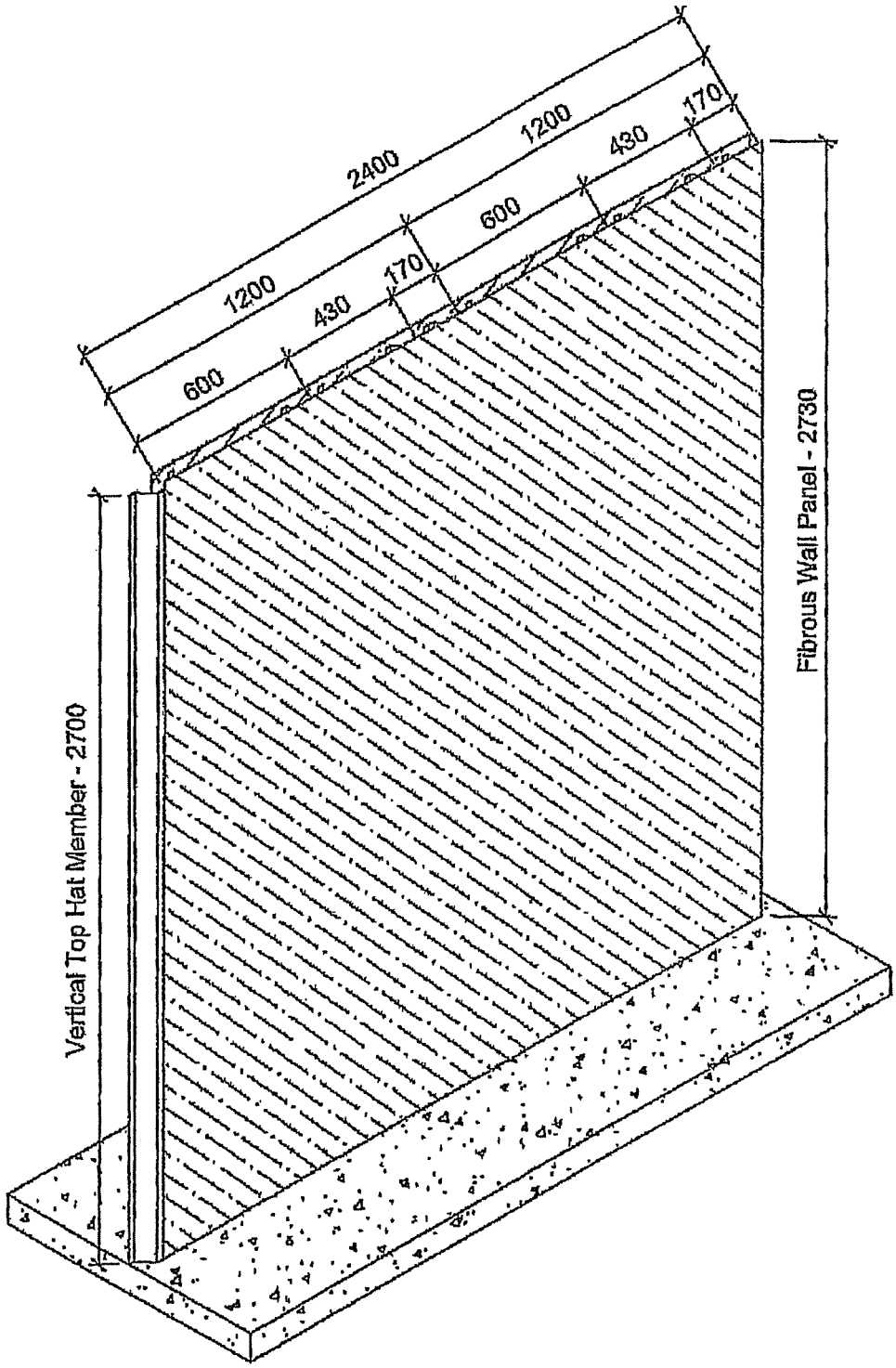
FIG. 5 is a perspective view of the panel assembly of FIG. 4 with sheeting applied.
Figure 6:
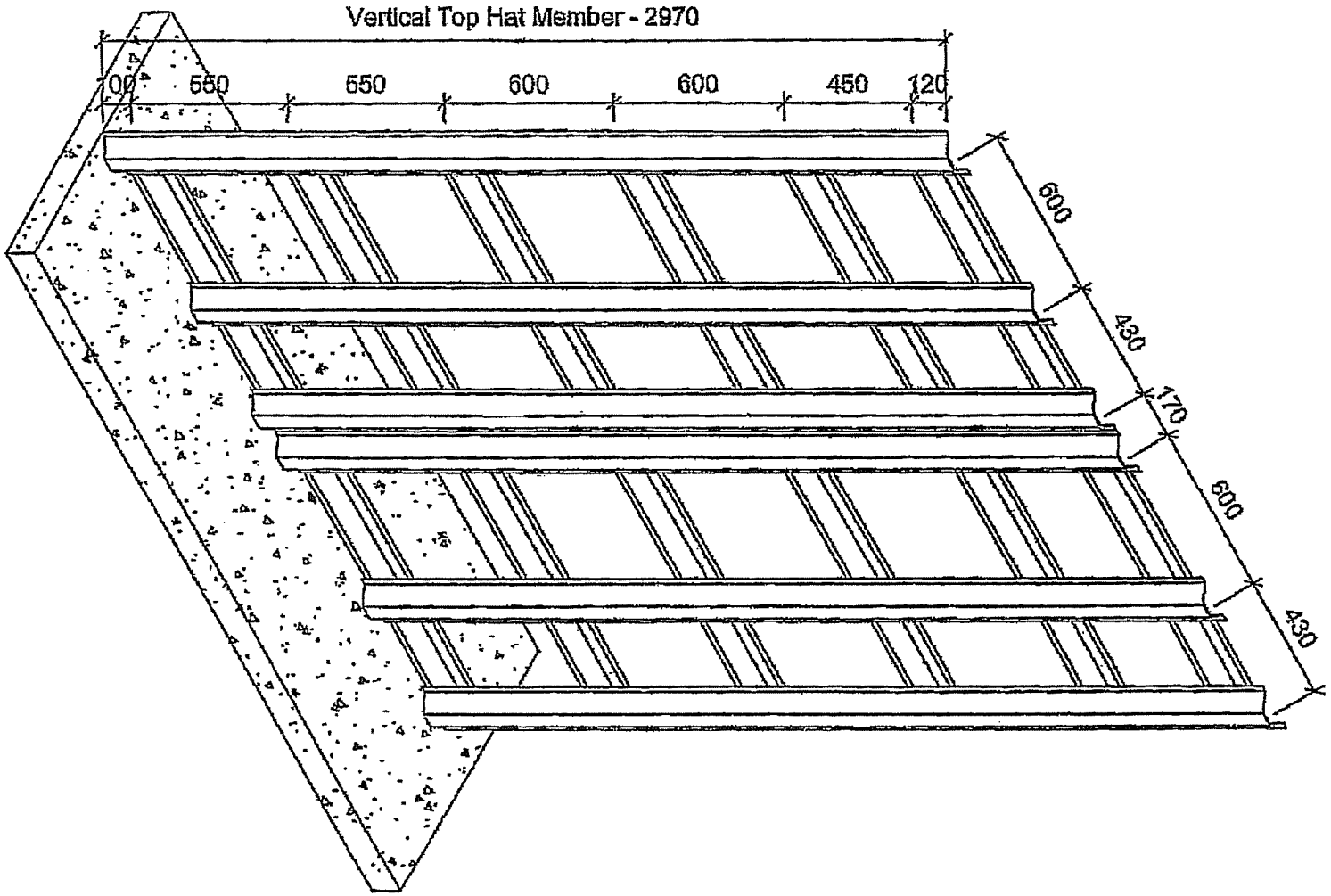
FIG. 6 is a perspective view of a 3000 mm panel assembly with two layer support frame with sheet members removed.
Figure 7:
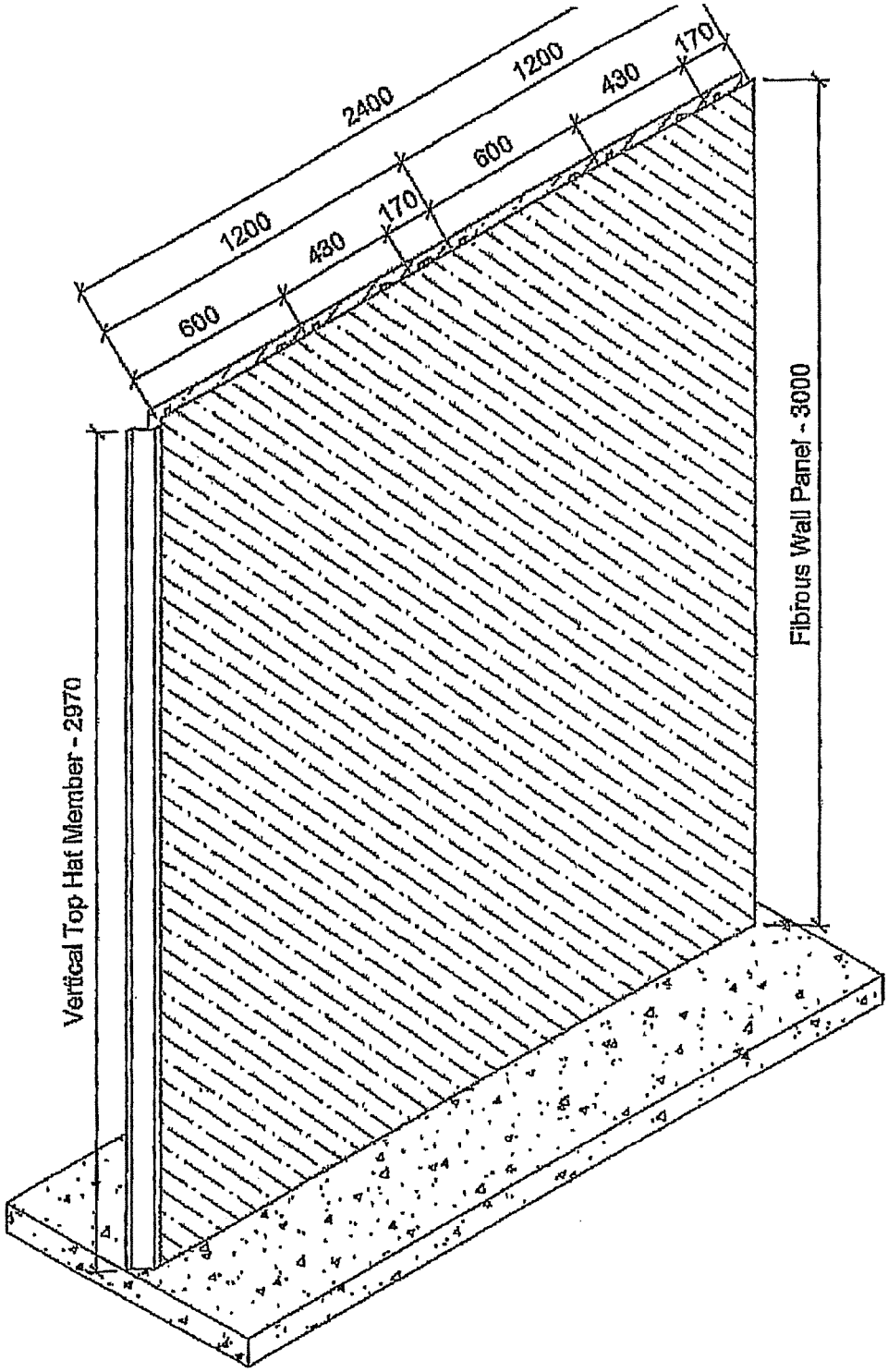
FIG. 7 is a perspective view of the panel assembly of FIG. 6 with sheeting applied.
Figure 8:
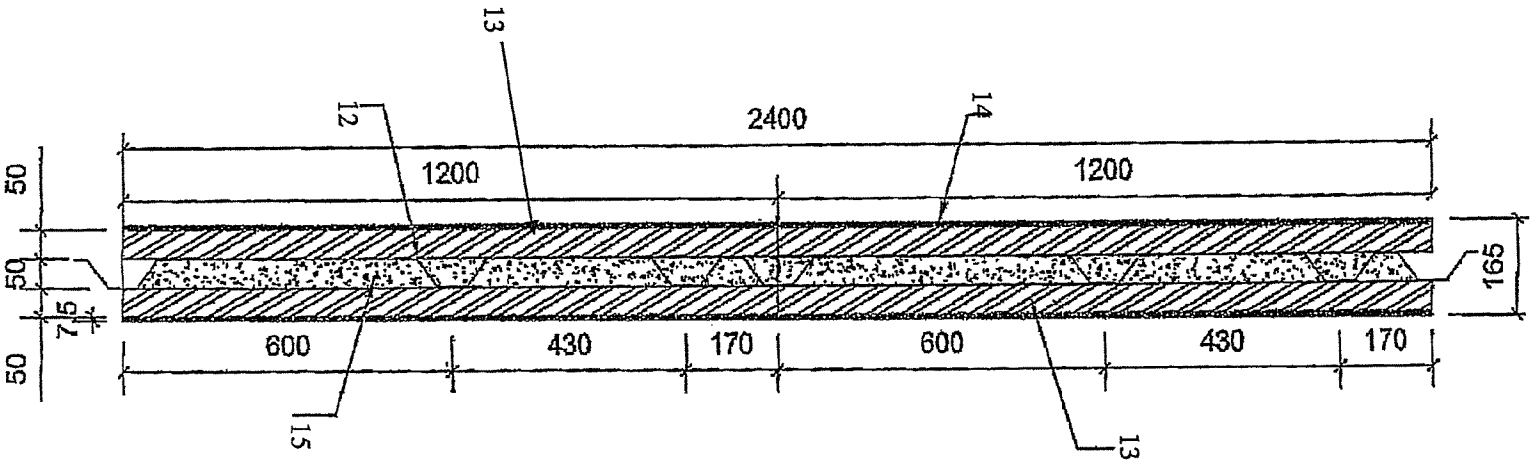
FIG. 8 is a sectional view of a panel assembly with a three layer support frame according to a preferred embodiment of the present invention.
Figure 9:
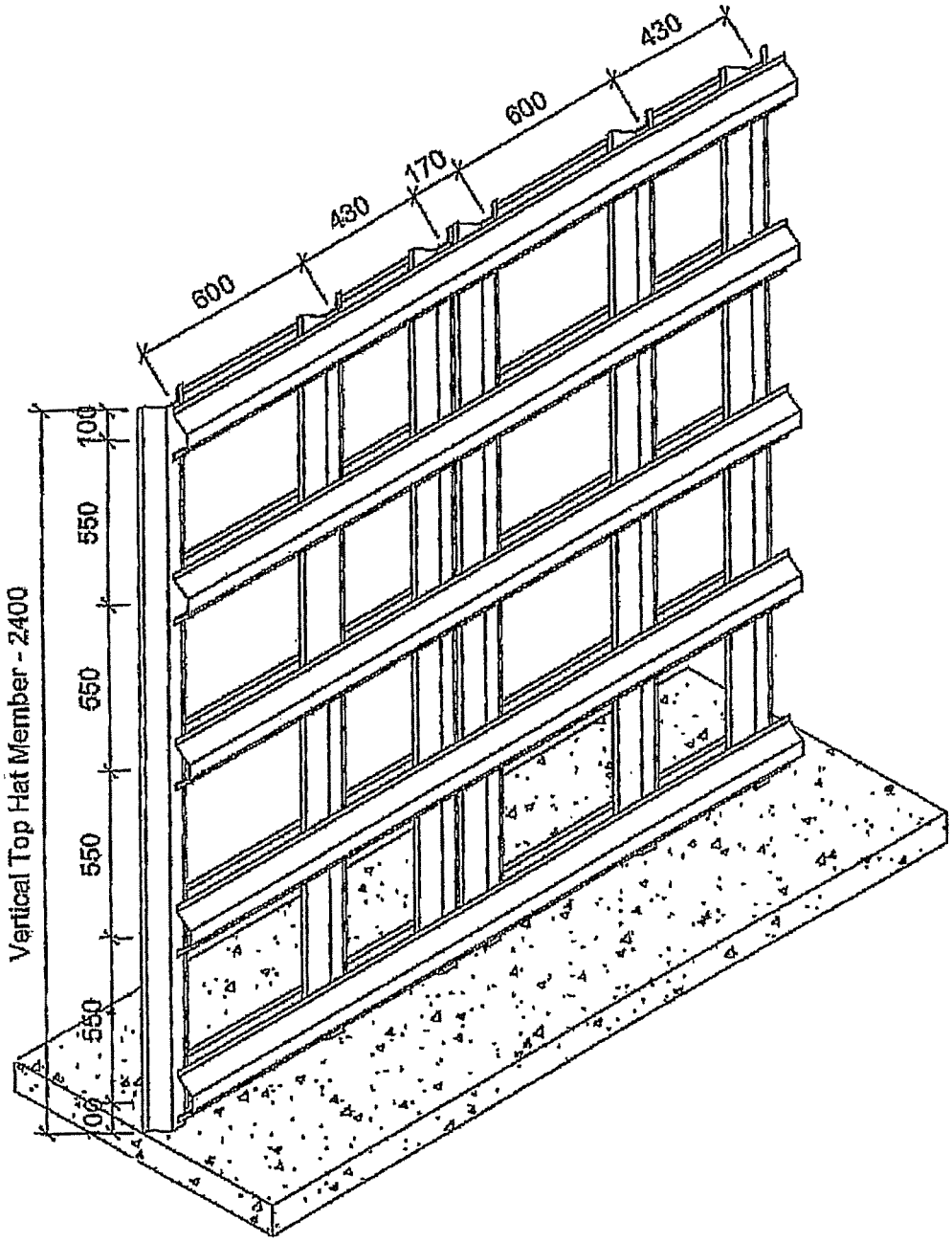
FIG. 9 is a perspective view of a 2400 mm panel assembly with three layer support frame with sheet members removed.
Figure 10:
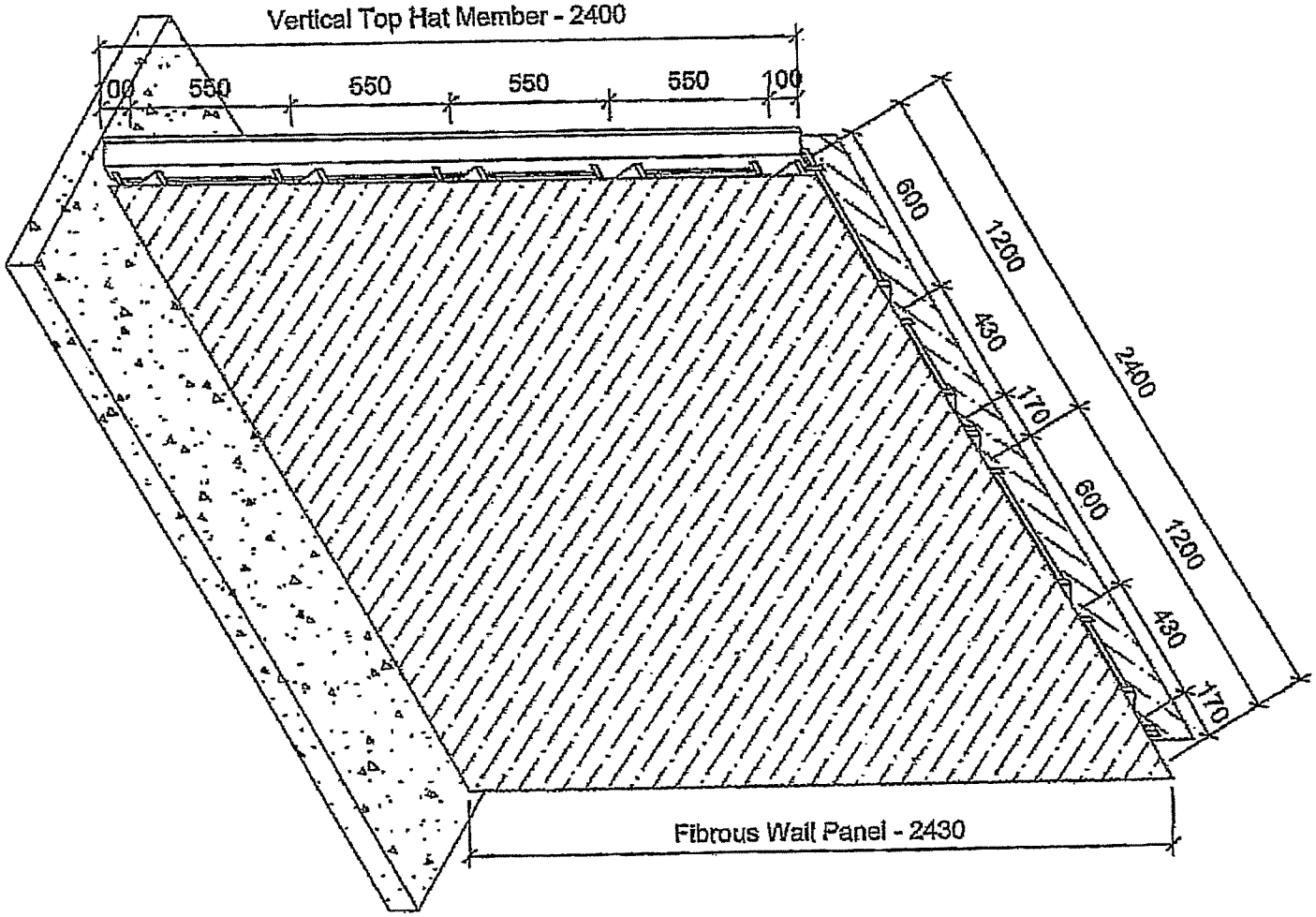
FIG. 10 is a perspective view of the panel assembly of FIG. 9 with sheeting applied.
Figure 11:
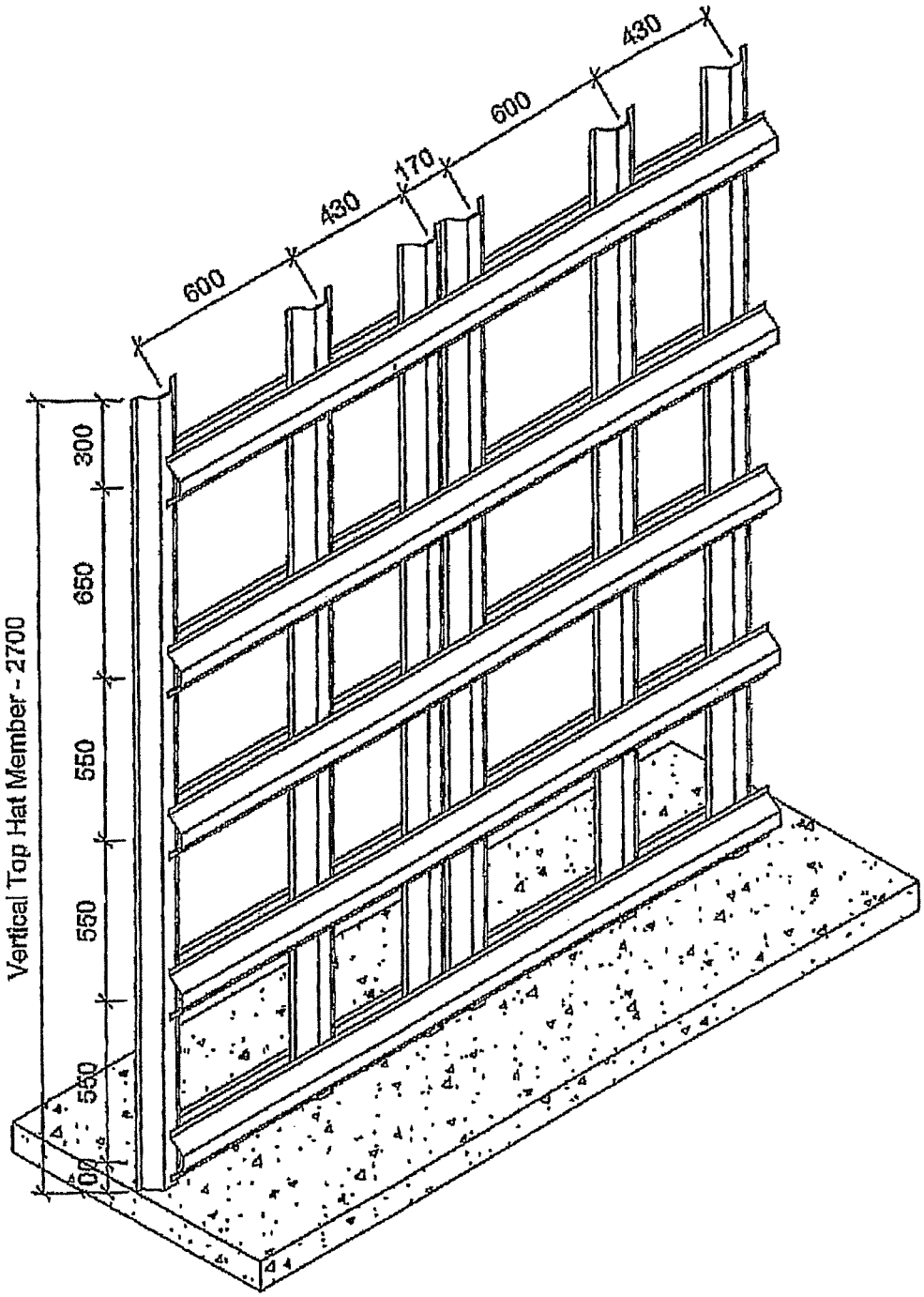
FIG. 11 is a perspective view of a 2700 mm panel assembly with three layer support frame with sheet members removed.
Figure 12:
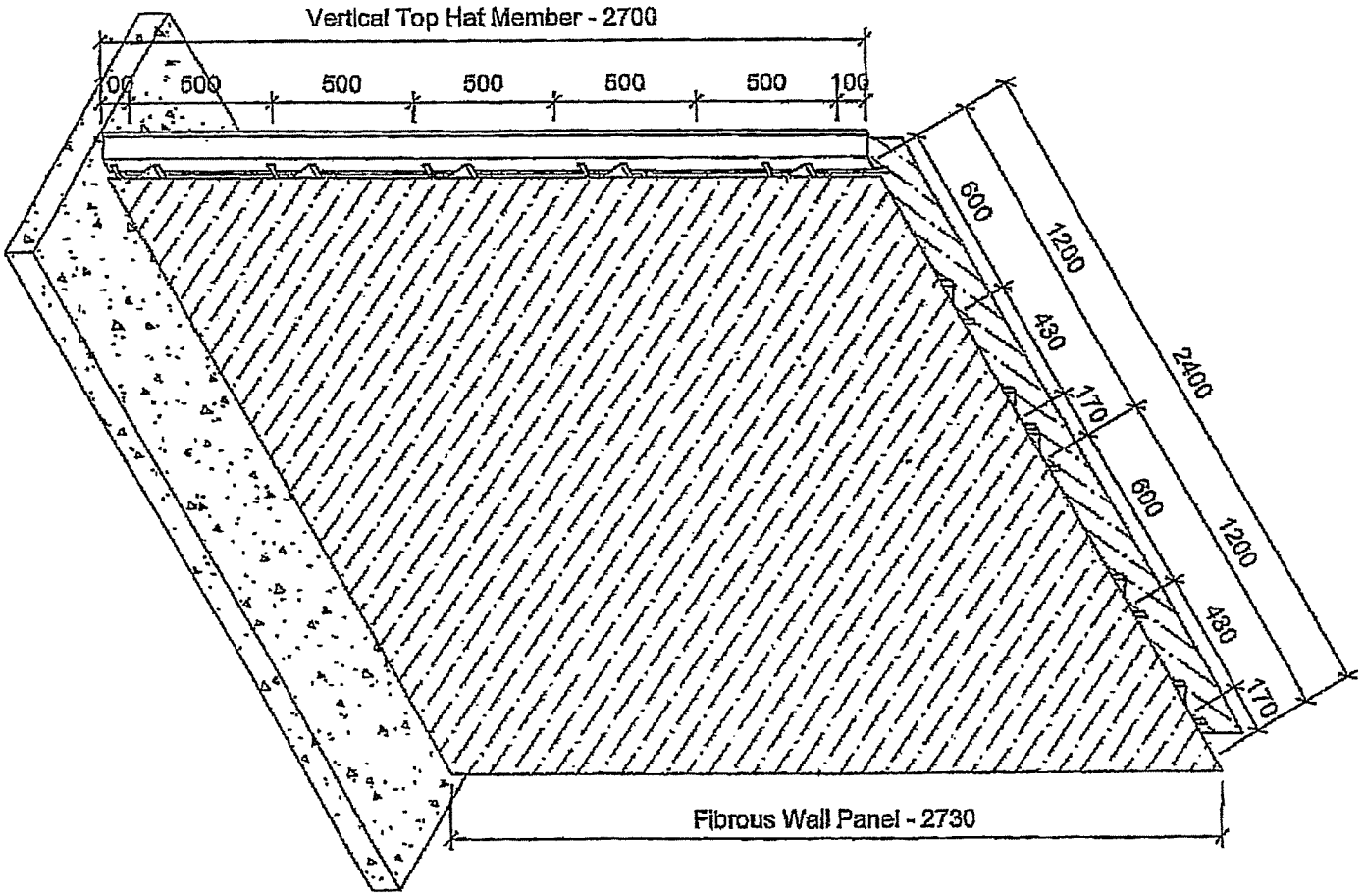
FIG. 12 is a perspective view of the panel assembly of FIG. 11 with sheeting applied.
Figure 13:
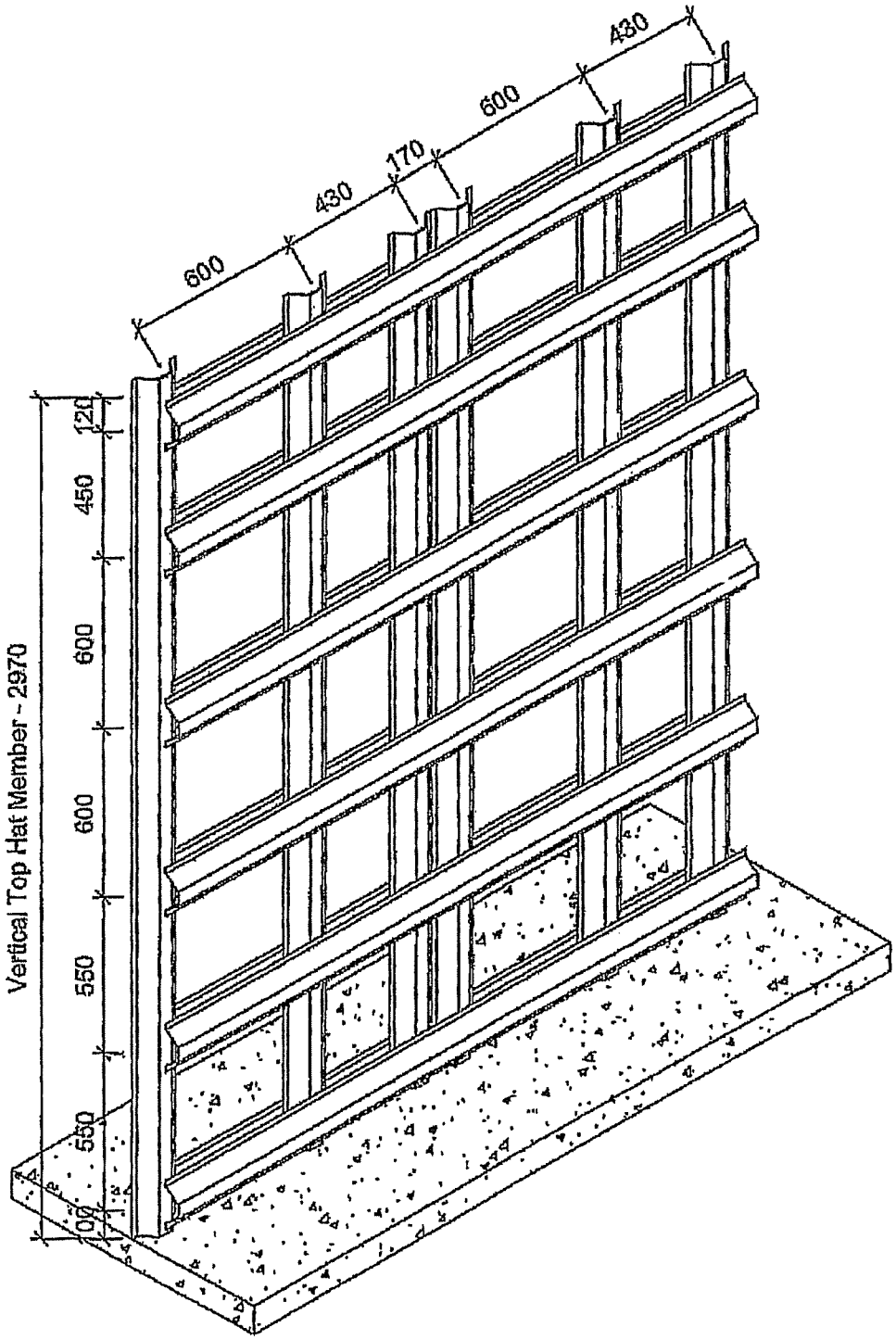
FIG. 13 is a perspective view of a 3000 mm panel assembly with three layer support frame with sheet members removed.
Figure 14:
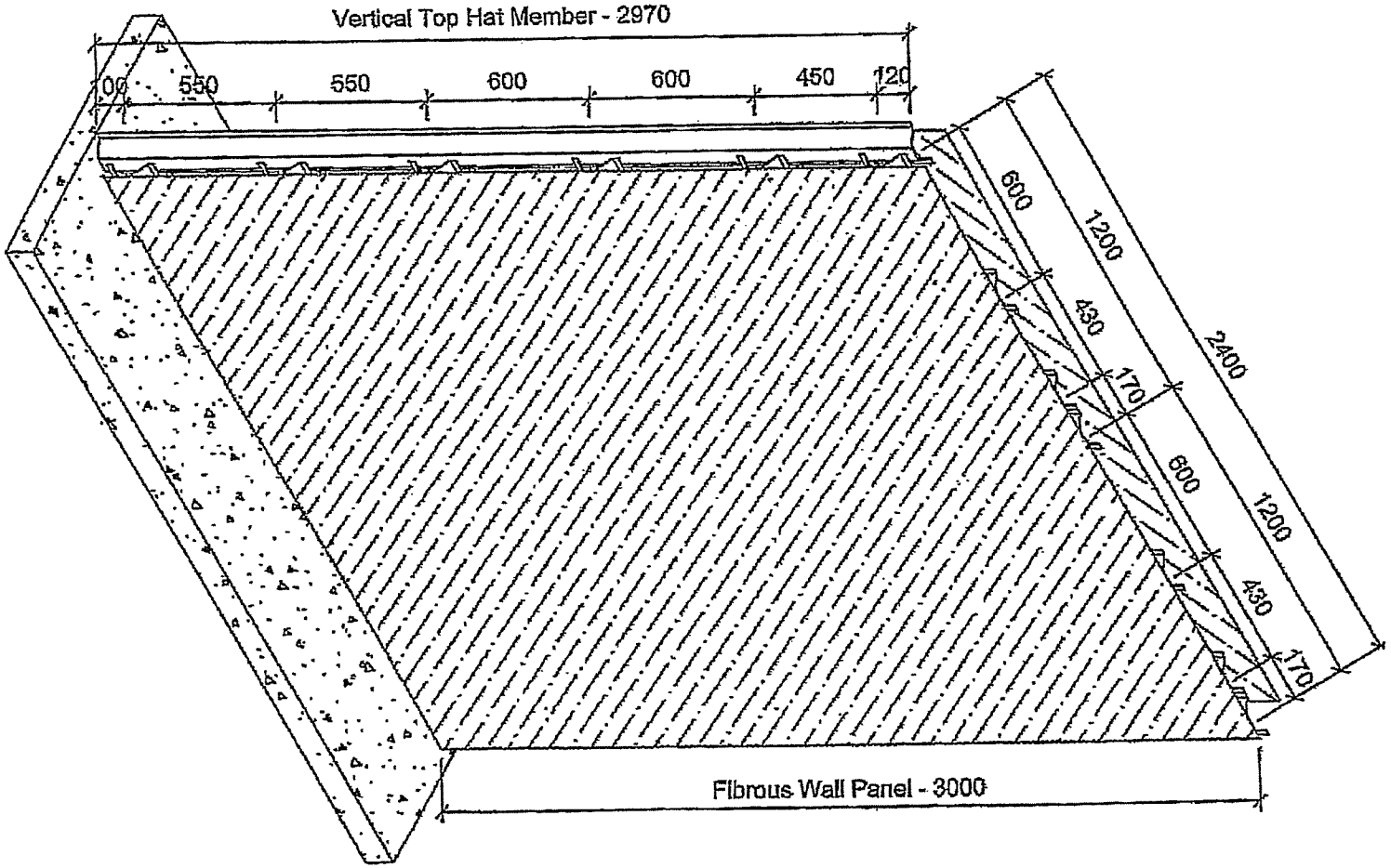
FIG. 14 is a perspective view of the panel assembly of FIG. 13 with sheeting applied.

The panel assembly as illustrated in the Figures includes a support frame 10, illustrated in FIG. 2 for example, that is mountable relative to a building substrate 11. The support frame 10 includes a plurality of vertical members 12 extending in a first direction and a plurality of horizontal members 13 extending in a second direction and overlaying the vertical members and attached thereto. As illustrated in the Figures, the panel also has sheeting members 14 provided on the support frame 10 so that the support frame 10 and the sheeting 14 define a zone for a cementitious material 15, positioned against the sheeting 14 to fill the zone.

The support frame 10 is normally erected first on the substrate 11. Mounting the sheeting 14 on the support frame 10 so that the support frame 10 is positioned between a pair of structural sheets 14 defines a zone in which cementitious material can be placed. The cementitious, settable material 15 can then be applied to an inner surface of the structural sheeting 14 to at least partially fill the zone with the settable material; and allowed to set.

The method typically includes mounting formwork on the support frame 10 so that the zone is bounded by the structural sheeting 14, the support frame 10 and the formwork and introducing the cementitious material 15 into the zone to cast the cementitious material in situ. The formwork may be removed once the cementitious material has set.

Preferably, at least two vertically spaced support members are removably secured between opposite ends of the support frame.

The method may further include the step of positioning steel reinforcing in the zone prior to applying the settable cementitious material.

The support frame members 12, 13 of the preferred embodiment are manufactured of metal and normally galvanised metal having rust resistant properties will be used. The members have a cross-sectional shape with a first planar side wall 16, a first angled wall 17, a central wall 18 parallel with the planar side wall 16, a second angled wall 19 angled in the opposite direction to the first angled wall 17 and a second side wall 20 parallel to both the first side wall 16 and central wall 18. This more preferred member shape possesses exceptional strength as well as an ability to flex due to the angled walls. In the illustrated embodiment, both the vertical members 12 and the horizontal members 13 have the preferred shape.

The vertical 12 and horizontal 13 members of the illustrated embodiment are the same members simply oriented in different directions. The members are a standard height between the side walls and the centre wall, preferably 50 mm. Using a 7.5 mm thick sheeting member on both sides makes the panel 115 mm thick as illustrated in FIGS. 1 to 7 and a three layer support structure with sheets on both sides results in a 165 mm panel as illustrated in FIGS. 8 to 14.

As illustrated in FIGS. 8 to 14, the support frame can further include a third set of members extending in the same direction as the horizontal members. The third members also have the preferred cross-sectional profile. The members of the support frame 10 are both screwed and welded together.

The sheeting 14 is normally manufactured from fibre cement, and alternate materials such as compressed recycled newspaper, rubber and other materials. It is particularly preferred that the sheeting material use materials appropriate for use carbon trading, carbon sequestration or sustainable building.

According to the illustrated embodiment, the sheets 14 are attached to the support frame 10 via the side walls 16, 20 of the members. When attached this way, the central walls 18 of the respective members in a two layer support frame 10 are attached to each other orienting the side walls 16, 20 outwardly on both sides of the support frame 10. In this configuration, sheeting is then attached to both sides of the support frame 10 to form a wall and define a cavity into which the cementitious material is placed.

Normally, the support frame 10 has a particular orientation when used for buildings, namely vertical members 12 oriented towards the outside of the building and the horizontal members 13 to the inside.

Figure 15:
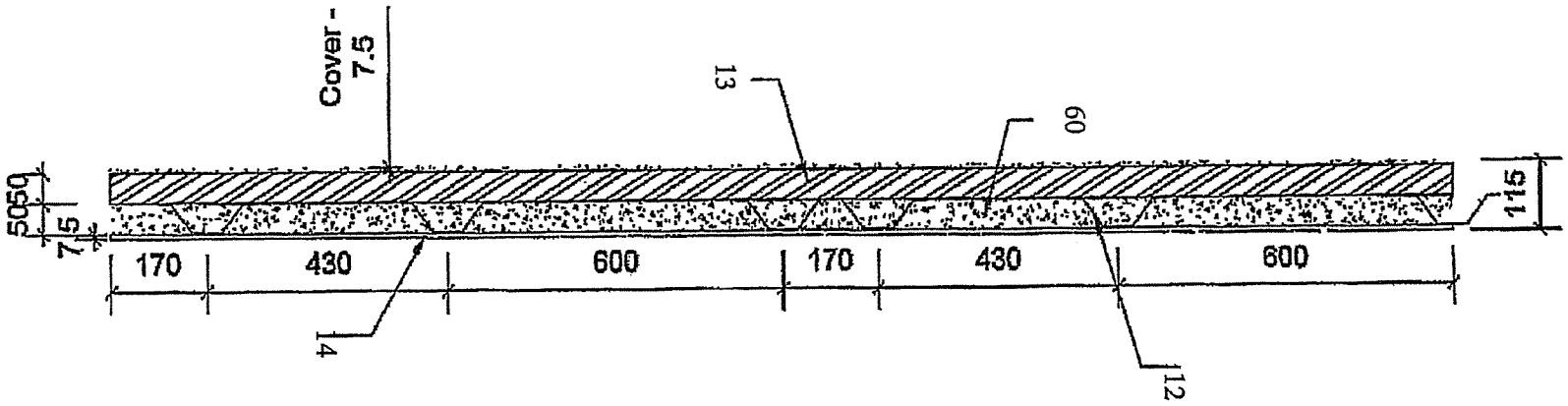
FIG. 15 is a sectional view of a floor panel assembly with a two layer support frame according to a preferred embodiment of the present invention.
Figure 16:
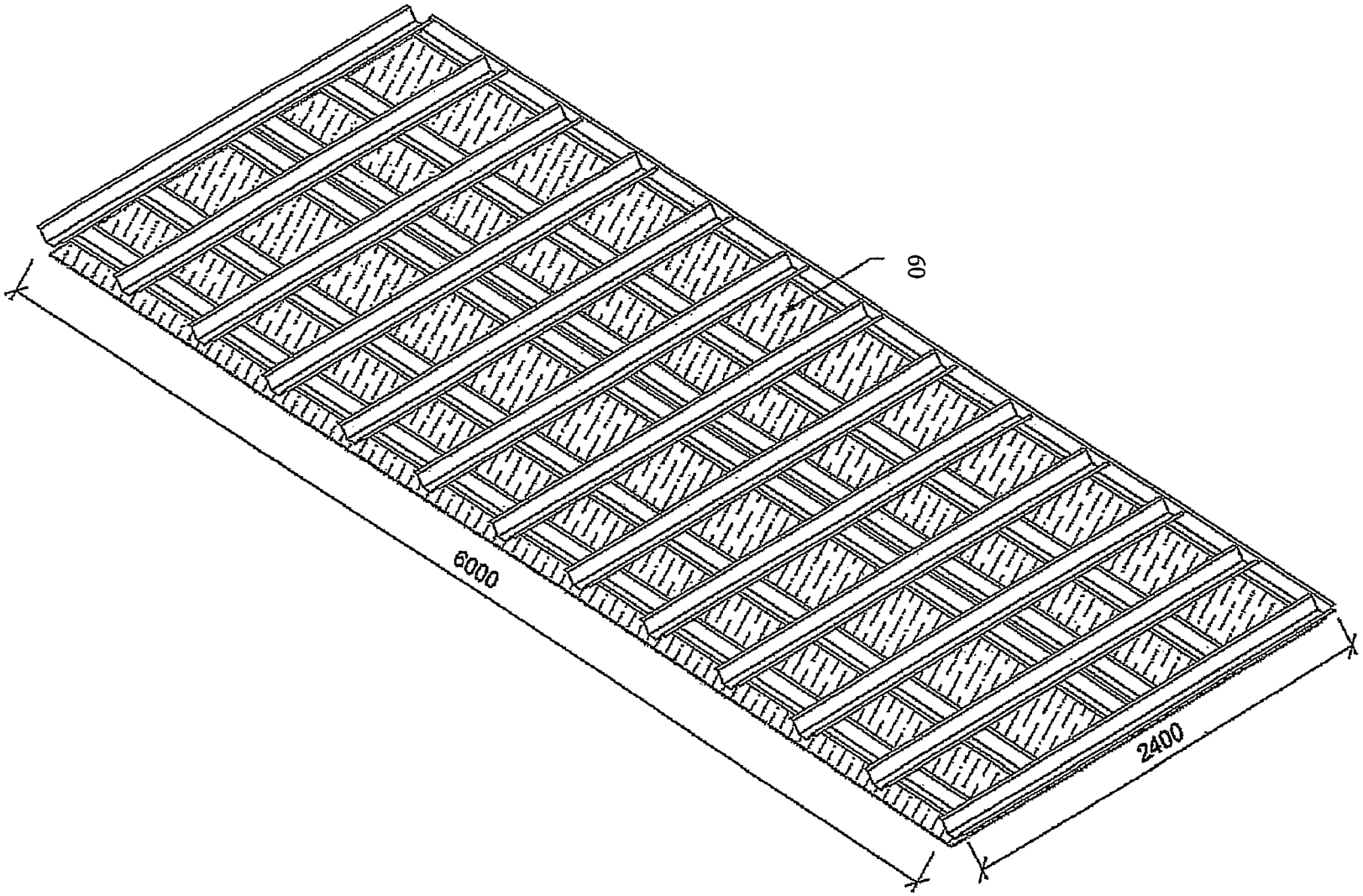
FIG. 16 is a perspective view of the panel assembly of FIG. 15 with sheeting applied to a first side.

The floor panel illustrated in FIGS. 15 to 17 is configured as described above with a support frame incorporating a plurality of members 12 extending in a first direction and a plurality of members 13 extending in a second direction as illustrated in FIG. 16 in particular. Each of the members 12, 13 are adapted to attach to the members extending in the other of the directions in a back to back configuration. The members have a first planar side wall, a first angled wall, a central wall parallel with the planar side wall, a second angled wall angled in the opposite direction to the first angled wall and a second side wall parallel to both the first side wall and central wall. The central walls of the respective members extending in different directions are normally attached to one another where the members overlie one another.

A sheet member 14 is attached to either side of the support frame. A sheet member 14 is normally applied to one side of the support frame, and the single sided assembly them put in place. A cementitious material is then usually located into the cavity 60 defined about the support frame and the upper sheet member 14 attached to the other side of the support frame to form the panel.

In the present specification and claims (if any), the word "comprising" and its derivatives including "comprises" and "comprise" include each of the stated integers but does not exclude the inclusion of one or more further integers.

Reference throughout this specification to "one embodiment" or "an embodiment" means that a particular feature, structure, or characteristic described in connection with the embodiment is included in at least one embodiment of the present invention. Thus, the appearance of the phrases "in one embodiment" or "in an embodiment" in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. A building construction system including a panel assembly for a building structure including a support frame that is mountable on a substrate, structural sheeting provided on the support frame so that the support frame is positioned between a pair of structural sheets and the support frame and the structural sheeting together define a zone for a cementitious material, a layer of cementitious material positioned against the structural sheeting to at least partially fill the zone wherein the support frame includes a plurality of members extending in a first direction, all of the members extending in the first direction being first members and at least a pair of members extending in a second direction, all of the members extending in the second direction being second members, each of the first members and second members having at least a pair of attachment surfaces extending parallel to each other, each of the said parallel attachment surfaces of each said first member and each said second member attaching either structural sheeting or other first members or second members through the respective parallel attachment surfaces.

2. A building construction system as claimed in claim 1 including a plurality of panel assemblies attached relative to one another.

3. A building construction system as claimed in claim 1 wherein the support frame is oriented such that a plurality of first members are provided substantially vertically and oriented towards an outer side of the building and a plurality of second members are provided horizontally members and oriented towards an inner side of the building.

4. A method of constructing a panel assembly for a building structure, the method including the steps of erecting a support frame on a substrate, the support frame including a plurality of members extending in a first direction, all of the members extending in the first direction being first members and at least two members extending in a second direction, all of the members extending in the second direction being second members each of the first members and second members having at least a pair of attachment surfaces extending parallel to each other, each of the said parallel attachment surfaces of each said first member and each said second member attaching either structural sheeting or other first members or second members through the respective parallel attachment surfaces, attaching structural sheeting on the support frame so that the support frame is positioned between a pair of structural sheets and the support frame and structural sheeting together define a zone in which cementitious material is to be set, applying a cementitious, settable material to an inner surface of the structural sheeting to at least partially fill the zone with the settable material; and allowing the cementitious material to set.

5. A method as claimed in claim 4 further including the steps of mounting formwork on the support frame so that the zone is bounded by the structural sheeting, the support frame and the formwork and introducing the cementitious material into the zone to cast the cementitious material in situ.

6. A method as claimed in claim 5 further including the step of removing the formwork once the cementitious material has set.

7. A method as claimed in claim 4 further including the step of spraying the cementitious material into the zone.

8. A method as claimed in claim 4 further including the step of removably securing transverse support members to the structural sheeting to support the structural sheeting while the cementitious material is sprayed onto the structural sheet.

9. A panel assembly for a building structure including a support frame that is mountable relative to a building substrate, the support frame including a plurality of first members extending in a first direction, all of the members extending in the first direction being first members and at least two members extending in a second direction and overlaying the members in the first direction, all of the members extending in the second direction being second members, each of the first members and second members having at least a pair of attachment surfaces extending parallel to each other, each of the said parallel attachment surfaces of each said first member and each said second member attaching either structural sheeting or other members through the respective parallel attachment surfaces, at least one sheeting member attached on at least one side of the support frame so that the support frame and the structural sheeting define a zone for a cementitious material, and a layer of cementitious material positioned against the structural sheeting to at least partially fill the zone.

10. A panel assembly according to claim 9 wherein the support frame further includes a third set of members extending substantially horizontally and attached on the opposite side of the second member to the first members.

11. A panel assembly according to claim 9 further including one or more post-tensioning members.

12. A panel assembly according to claim 11 wherein the one or more post-tensioning members extend through the cementitious settable material and once the cementitious material has set to a predetermined extent, a predetermined tension is applied to the one or more post-tensioning members.

13. A building construction system including a panel assembly for a building structure including a support frame that is mountable on a substrate, structural sheeting provided on the support frame so that the support frame is positioned between a pair of structural sheets and the support frame and the structural sheeting together define a hollow zone between the structural sheeting wherein the support frame includes a plurality of members extending in a first direction, all of the members extending in the first direction being first members and at least two members extending in a second direction, all of the members extending in the second direction being second members, each of the first members and second members having at least a pair of attachment surfaces extending parallel to each other, each of the said parallel attachment surfaces of each said first member and each said second member attaching either structural sheeting or other first members or second members through the respective parallel attachment surfaces.

14. A method of forming a panel assembly including the steps of erecting a support frame on a substrate, the support frame including a plurality of members extending in a first direction, all of the members extending in the first direction being first members and at least one member extending in a second direction, all of the members extending in the second direction being second members, each of the members having at least a pair of attachment surfaces extending parallel to each other, attaching structural sheeting on the support frame so that the support frame is positioned on one side of the structural sheeting, the support frame and structural sheeting together define one or more hollow zones in which cementitious material is to be set, initially applying the cementitious settable material to an inner surface of the structural sheeting in some of the hollow zones, allowing the material in those zones to at least partially set, applying the settable material to remaining zones, and using the at least partially set material in the zones as a guide for screeding the material in the remaining zones; and allowing the cementitious material to set.

15. A method of forming a panel assembly as claimed in claim 14 wherein the step of initially applying the cementitious settable material to some of the hollow zones, occurs in alternating zones.

* * * * *